US010982169B2

(12) United States Patent
Broutin et al.

(10) Patent No.: US 10,982,169 B2
(45) Date of Patent: Apr. 20, 2021

(54) POLYALKYLENE GLYCOL-BASED LUBRICANT COMPOSITION

(71) Applicants: TOTAL MARKETING SERVICES, Puteaux (FR); DOW GLOBAL TECHNOLOGIES LLC, Midland, MI (US)

(72) Inventors: Laura Broutin, Ternay (FR); Nicolas Obrecht, Meistratzheim (FR); Nadjet Khelidj-Suedmeyer, Horgen (CH)

(73) Assignees: TOTAL MARKETING SERVICES, Puteaux (FR); DOW GLOBAL TECHNOLOGIES LLC, Midland, MI (US)

( * ) Notice: Subject to any disclaimer, the term of this patent is extended or adjusted under 35 U.S.C. 154(b) by 0 days.

(21) Appl. No.: 16/084,823

(22) PCT Filed: Mar. 15, 2017

(86) PCT No.: PCT/EP2017/056058
§ 371 (c)(1),
(2) Date: Sep. 13, 2018

(87) PCT Pub. No.: WO2017/157979
PCT Pub. Date: Sep. 21, 2017

(65) Prior Publication Data

US 2019/0071616 A1 Mar. 7, 2019

(30) Foreign Application Priority Data

Mar. 15, 2016 (FR) ..... 16 52188

(51) Int. Cl.

| | |
|---|---|
| ***C10M 169/04*** | (2006.01) |
| ***C10M 107/34*** | (2006.01) |
| ***C10M 133/54*** | (2006.01) |
| ***C10M 137/08*** | (2006.01) |
| ***C10M 135/18*** | (2006.01) |
| *C10N 30/04* | (2006.01) |
| *C10N 30/06* | (2006.01) |
| *C10N 30/00* | (2006.01) |
| *C10N 40/25* | (2006.01) |

(52) U.S. Cl.

CPC ..... *C10M 169/04* (2013.01); *C10M 107/34* (2013.01); *C10M 133/54* (2013.01); *C10M 135/18* (2013.01); *C10M 137/08* (2013.01); *C10M 2203/1025* (2013.01); *C10M 2205/04* (2013.01); *C10M 2207/026* (2013.01); *C10M 2207/262* (2013.01); *C10M 2209/084* (2013.01); *C10M 2209/1033* (2013.01); *C10M 2209/1045* (2013.01); *C10M 2209/1055* (2013.01); *C10M 2209/1065* (2013.01); *C10M 2209/1075* (2013.01); *C10M 2215/064* (2013.01); *C10M 2215/26* (2013.01); *C10M 2215/28* (2013.01); *C10M 2219/068* (2013.01); *C10M 2223/043* (2013.01); *C10M 2223/045* (2013.01); *C10M 2227/066* (2013.01); *C10M 2227/09* (2013.01); *C10N 2030/04* (2013.01); *C10N 2030/06* (2013.01); *C10N 2030/54* (2020.05); *C10N 2040/25* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,342,531 | A * | 8/1994 | Walters | C10M 141/10 508/272 |
| 9,546,335 | B2 | 1/2017 | Obrecht et al. | |
| 9,957,462 | B2 | 5/2018 | Guerin et al. | |
| 2007/0042917 | A1* | 2/2007 | Ravichandran | C07F 11/005 508/251 |
| 2007/0203032 | A1 | 8/2007 | Tynik et al. | |
| 2007/0203033 | A1 | 8/2007 | Ytnik et al. | |
| 2014/0303053 | A1* | 10/2014 | Greaves | C10M 169/04 508/282 |
| 2015/0126419 | A1* | 5/2015 | Lerasle | C10M 161/00 508/364 |
| 2017/0226442 | A1 | 8/2017 | Sanson et al. | |

FOREIGN PATENT DOCUMENTS

| | | | |
|---|---|---|---|
| CN | 103 694 104 | A | 4/2014 |
| DE | 10 2005 011776 | A | 9/2006 |
| WO | 2008/116099 | A1 | 9/2008 |
| WO | 2012/070007 | A1 | 5/2012 |
| WO | 2013/077948 | A1 | 5/2013 |
| WO | 2013/164449 | A1 | 11/2013 |
| WO | 2016/016362 | A1 | 2/2016 |

OTHER PUBLICATIONS

Vanderbilt: "Lubricant Additives", Apr. 12, 2015 (Apr. 12, 2015), XP055315047, Retrieved from the Internet <URL:http://www.vanderbiltchemicals.com/ee_content/Documents/Technical/Lubricant_Additive_Brochure_Domestic_Web.pdf> [retrieved on Oct. 31, 2016].

International Search Report, dated May 29, 2017, from corresponding PCT/EP2017/056058 application.

* cited by examiner

*Primary Examiner* — Ellen M McAvoy
*Assistant Examiner* — Chantel L Graham
(74) *Attorney, Agent, or Firm* — Nixon & Vanderhye

(57) ABSTRACT

A lubricant composition includes: an oil selected from among polyalkylene glycols (PAG); and a nitrogen compound selected from among amine phosphates or amine tungstates. The lubricant composition is particularly suitable for lubricating a vehicle engine, preferably a motor vehicle engine. Also disclosed is an engine lubrication method utilizing such composition.

11 Claims, No Drawings

POLYALKYLENE GLYCOL-BASED LUBRICANT COMPOSITION

The present application relates to the field of lubricating compositions, especially lubricating compositions for a vehicle engine, in particular for a motor vehicle engine. In particular, the present application relates to lubricating compositions based on polyalkylated glycols (PAG or polyalkylene glycols) for the lubrication of a vehicle engine, especially a motor vehicle.

Energy efficiency and reduced fuel consumption of automotive engines is a growing concern. It is known that engine lubricants used in automotive vehicles play an important role in this respect.

To formulate economic fuel lubricants or fuel economizers, it is known to play on the viscosity of the lubricating bases used. It is also known to use polymers to improve the viscosity index (VI), or to use friction modifiers. However, the polymers improving the viscosity index have the disadvantage of degrading the engine cleanliness of the lubricating compositions in which they are used. However, current engines have high thermal stresses that cause significant deposition phenomena. The deposits are related to the chemical transformation of the lubricant in the parts closest to the combustion chamber and therefore the hottest parts.

Fuel economy lubricating compositions based on polyalkylated glycols (PAG or polyalkylene glycols) have been described in document WO 2013/164449, wherein the compositions also have good properties for engine cleanliness.

However, the use of these PAG may sometimes cause an increase in the wear of the mechanical parts of the engine, and therefore a degradation of the service life of the engine.

It is, therefore, of interest to provide a lubricating composition, especially a lubricating composition for motor vehicle engines, to overcome all or part of the drawbacks of the prior art.

One object of the present invention is to provide a lubricating composition based on PAG, in particular a lubricating composition based on PAG for motor vehicle engines, offering improved anti-wear properties.

Another object of the present invention is to provide a lubricating composition based on PAG, in particular a lubricating composition based on PAG for a motor vehicle engine, offering both improved anti-wear properties and satisfactory fuel economy properties.

Another object of the present invention is to provide a lubricating composition based on PAG, especially a PAG lubricating composition for a motor vehicle engine, offering improved anti-wear properties as well as not degrading engine cleanliness.

Another object of the present invention is to provide a lubricating composition based on PAG, especially a PAG lubricating composition for a motor vehicle engine, offering improved anti-wear properties and satisfactory fuel economy properties, while not degrading engine cleanliness.

Another object of the invention is to provide a lubricating composition based on PAG, in particular a lubricating composition based on PAG for a motor vehicle engine, offering improved anti-wear properties and that is easy to formulate.

In order to achieve the above objectives and overcome the cited drawbacks in the prior art, the present invention proposes a lubricating composition comprising:

- an oil chosen from polyalkyl glycols (PAG or polyalkylene glycols), and
- a nitrogen compound chosen from amine phosphates or amine tungstates.

Particularly advantageously, the lubricating composition of the present invention is a lubricating composition for an engine, preferably a vehicle, more preferably a motor vehicle.

The nitrogen compound according to the invention may be chosen from amine phosphates, wherein the composition preferably further comprises a friction modifier chosen from organomolybdenum compounds, preferably chosen from molybdenum dithiocarbamates and their derivatives.

Preferably, the nitrogen compound according to the invention is an amine phosphate chosen from:

compounds of formula (IA)

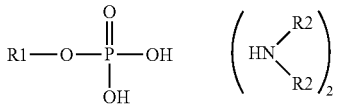

(IA)

in which:

R1 represents a linear or branched alkyl group comprising from 2 to 10 carbon atoms, preferably from 3 to 9 carbon atoms, more preferably from 5 to 8 carbon atoms;

R2 represents a linear or branched alkyl group comprising from 8 to 15 carbon atoms, preferably from 9 to 14 carbon atoms, more preferably from 10 to 14 carbon atoms;

compounds of formula (IB)

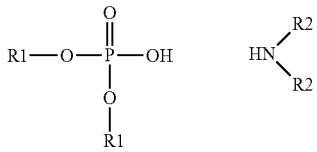

(IB)

in which:

R1 represents a linear or branched alkyl group comprising from 2 to 10 carbon atoms, preferably from 3 to 9 carbon atoms, more preferably from 5 to 8 carbon atoms;

R2 represents a linear or branched alkyl group comprising from 8 to 15 carbon atoms, preferably from 9 to 14 carbon atoms, more preferably from 10 to 14 carbon atoms;

a mixture of at least one compound of formula (IA) and at least one compound of formula (IB).

More preferably, the nitrogen compound according to the invention is an amine phosphate selected from:

compounds of formula (IA)

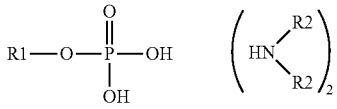

(IA)

in which:

R1 represents a linear alkyl group comprising from 2 to 10 carbon atoms, preferably from 3 to 9 carbon atoms, more preferably from 5 to 8 carbon atoms;

R2 represents a linear or branched alkyl group comprising from 8 to 15 carbon atoms, preferably from 9 to 14 carbon atoms, more preferably from 10 to 14 carbon atoms;

compounds of formula (IB)

(IB)

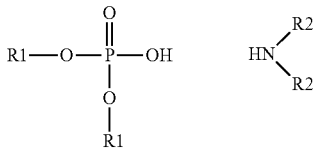

in which:

R1 represents a linear alkyl group comprising from 2 to 10 carbon atoms, preferably from 3 to 9 carbon atoms, more preferably from 5 to 8 carbon atoms;

R2 represents a linear or branched alkyl group comprising from 8 to 15 carbon atoms, preferably from 9 to 14 carbon atoms, more preferably from 10 to 14 carbon atoms;

a mixture of at least one compound of formula (IA) and at least one compound of formula (IB).

Also more preferably, the nitrogen compound according to the invention is an amine phosphate selected from:

compounds of formula (IA)

(IA)

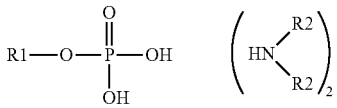

in which:

R1 represents a branched alkyl group comprising from 2 to 10 carbon atoms, preferably from 3 to 9 carbon atoms, more preferably from 5 to 8 carbon atoms;

R2 represents a linear or branched alkyl group comprising from 8 to 15 carbon atoms, preferably from 9 to 14 carbon atoms, more preferably from 10 to 14 carbon atoms;

compounds of formula (IB)

(IB)

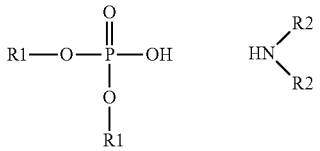

in which:

R1 represents a branched alkyl group comprising from 2 to 10 carbon atoms, preferably from 3 to 9 carbon atoms, more preferably from 5 to 8 carbon atoms;

R2 represents a linear or branched alkyl group comprising from 8 to 15 carbon atoms, preferably from 9 to 14 carbon atoms, more preferably from 10 to 14 carbon atoms;

a mixture of at least one compound of formula (IA) and at least one compound of formula (IB).

Also more preferably, the nitrogen compound according to the invention is an amine phosphate selected from compounds of formula (IA)

(IA)

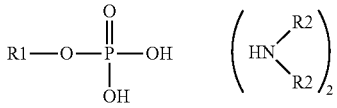

in which:

R1 represents a linear or branched alkyl group comprising from 2 to 10 carbon atoms, preferably from 3 to 8 carbon atoms, more preferably from 4 to 7 carbon atoms;

R2 represents a linear alkyl group comprising from 8 to 15 carbon atoms, preferably from 9 to 14 carbon atoms, more preferably from 10 to 14 carbon atoms;

compounds of formula (IB)

(IB)

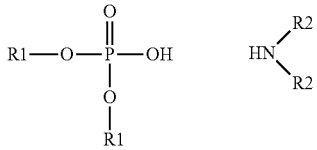

in which:

R1 represents a linear or branched alkyl group comprising from 2 to 10 carbon atoms, preferably from 3 to 8 carbon atoms, more preferably from 4 to 7 carbon atoms;

R2 represents a linear alkyl group comprising from 8 to 15 carbon atoms, preferably from 9 to 14 carbon atoms, more preferably from 10 to 14 carbon atoms;

a mixture of at least one compound of formula (IA) and at least one compound of formula (IB).

Also more preferably, the nitrogen compound according to the invention is an amine phosphate selected from:

compounds of formula (IA)

(IA)

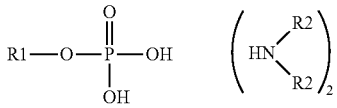

in which:

R1 represents a linear or branched alkyl group comprising from 2 to 10 carbon atoms, preferably from 3 to 8 carbon atoms, more preferably from 4 to 7 carbon atoms;

R2 represents a branched alkyl group comprising from 8 to 15 carbon atoms, preferably from 9 to 14 carbon atoms, more preferably from 10 to 14 carbon atoms;

compounds of formula (IB)

(IB)

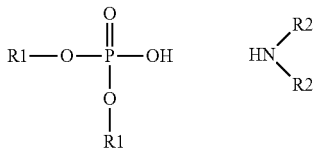

in which:

R1 represents a linear or branched alkyl group comprising from 2 to 10 carbon atoms, preferably from 3 to 8 carbon atoms, more preferably from 4 to 7 carbon atoms;

R2 represents a branched alkyl group comprising from 8 to 15 carbon atoms, preferably from 9 to 14 carbon atoms, more preferably from 10 to 14 carbon atoms;

a mixture of at least one compound of formula (IA) and at least one compound of formula (IB).

Advantageously, the nitrogen compound is a mixture of at least one compound of formula (IA) and at least one compound of formula (IB) in which:

R1 represents a hexyl or ethylhexyl group,

R2 represents a linear or branched alkyl group comprising from 11 to 14 carbon atoms, preferably a linear or branched C13-alkyl group.

The nitrogen compound according to the invention may be chosen from amine tungstates.

Amine tungstates according to the invention and their method of preparation are described in International Patent Application WO-2008/116099 or in International Patent Application WO-2013/077948.

Also preferably, the nitrogen compound according to the invention is chosen from:

amine tungstates obtained from at least one fatty amine comprising at least one linear alkyl group comprising from 8 to 15 carbon atoms, preferably from 9 to 14 carbon atoms, more preferably from 10 to 14 carbon atoms;

amine tungstates obtained from at least one fatty amine comprising at least one branched alkyl group comprising from 8 to 15 carbon atoms, preferably from 9 to 14 carbon atoms, more preferably from 10 to 14 carbon atoms;

a mixture of at least one amine tungstate obtained from at least one fatty amine comprising at least one linear alkyl group comprising from 8 to 15 carbon atoms, preferably from 9 to 14 carbon atoms, more preferably from 10 to 14 carbon atoms and an amine tungstate obtained from at least one fatty amine comprising at least one branched alkyl group comprising from 8 to 15 carbon atoms, preferably from 9 to 14 carbon atoms, plus preferably from 10 to 14 carbon atoms.

More preferably, the nitrogen compound is a mixture of at least one amine tungstate obtained from at least one fatty amine comprising at least one linear alkyl group comprising from 11 to 14 carbon atoms, preferably a linear or branched $C_{13}$-alkyl group and an amine tungstate obtained from at least one fatty amine comprising at least one branched alkyl group comprising from 11 to 14 carbon atoms, preferably a linear or branched $C_{13}$-alkyl group.

Examples of nitrogen compounds according to the invention include the Irgalube 349 product marketed by BASF or the product Vanlube W-324® marketed by Vanderbilt.

Preferably, the lubricating composition according to the invention comprises from 0.1 to 3%, preferably from 0.1 to 2%, more preferably from 0.4 to 1.5% by weight of nitrogen compound.

According to the invention, the PAG of the lubricating composition according to the invention may be a block polymer or a random polymer.

The PAG according to the invention comprises alkyl groups whose length of the hydrocarbon chains may vary. According to the invention, the length of the hydrocarbon chains is defined by a mean value of the number of carbon atoms.

Preferably, the PAG of the composition according to the invention PAG is a block polymer of formula (II) or a random polymer of formula (II)

(II)

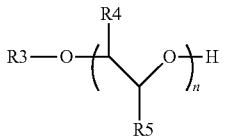

in which:

R3 represents a linear or branched $C_1$-$C_{30}$-alkyl group, preferably a linear or branched $C_4$-$C_{12}$-alkyl group;

n represents a number ranging from 2 to 60, preferably from 5 to 30 or from 7 to 15;

R4 and R5, identical or different, independently represent a hydrogen atom or a $C_1$-$C_2$-alkyl group.

For the PAG according to the invention, n may represent a number ranging from 2 to 60, preferably ranging from 5 to 30 or from 7 to 15.

For a preferred PAG according to the invention, R3 represents a linear or branched $C_4$-$C_{12}$-alkyl group, R4 and R5 are different and independently represent a hydrogen atom or a linear $C_1$-$C_2$-alkyl group and n represents a number ranging from 7 to 15.

Also preferably, the PAG of the composition according to the invention is a block polymer of formula (IIA) or a random polymer of formula (IIA)

(IIA)

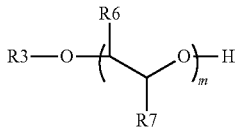

in which:

R3 represents a linear or branched $C_1$-$C_{30}$-alkyl group, preferably a linear or branched $C_4$-$C_{12}$-alkyl group;

m represents a number ranging from 2 to 60, preferably from 5 to 30 or from 7 to 15;

R6 and R7 represent a hydrogen atom; or R6 represents a hydrogen atom and R7 represents a methyl group; or R6 represents a methyl group and R7 represents a hydrogen atom; or R6 and R7 represent a methyl group; or R6 represents an ethyl group and R7 represents a hydrogen atom; or R6 represents a hydrogen atom and R7 represents an ethyl group.

For the PAG according to the invention, m may represent a number ranging from 2 to 60, preferably ranging from 5 to 30 or from 7 to 15.

For a preferred PAG according to the invention, R3 represents a linear or branched $C_4$-$C_{12}$-alkyl group, R6 and R7 are different and independently represent a hydrogen atom, a methyl group or an ethyl group and m represents a number ranging from 7 to 15.

Also preferably, the PAG of the composition according to the invention is a block polymer of formula (IIB) or a random polymer of formula (IIB)

(IIB)

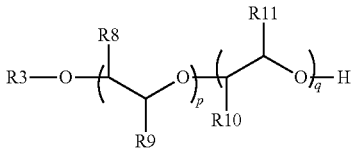

in which:

R3 represents a linear or branched $C_1$-$C_{30}$-alkyl group, preferably a linear or branched $C_4$-$C_{12}$-alkyl group, more preferably a linear or branched $C_8$-$C_{12}$-alkyl group;

p and q independently represent a number ranging from 1 to 30, preferably from 2 to 15 or from 2 to 8;

R8 and R9 represent a hydrogen atom; or R8 represents a hydrogen atom and R9 represents a methyl group; or R8 represents a methyl group and R9 represents a hydrogen atom; or R8 and R9 represent a methyl group; or R8 represents an ethyl group and R9 represents a hydrogen atom; or R8 represents a hydrogen atom and R9 represents an ethyl group;

R10 and R11 represent a hydrogen atom; or R10 represents a hydrogen atom and R11 represents a methyl group; or R10 represents a methyl group and R11 represents a hydrogen atom; or R10 and R11 represent a methyl group; or R10 represents an ethyl group and R11 represents a hydrogen atom; or R10 represents a hydrogen atom and R11 represents an ethyl group.

For the PAG according to the invention, p and q may independently represent a number ranging from 1 to 30, preferably from 2 to 15 or from 2 to 8.

As particular PAG according to the invention, mention may be made of:

for which R8, R9, R10 and R11 represent a hydrogen atom; or

PAG for which R8 and R10 represent a hydrogen atom and R9 and R11 represent a methyl group; or PAG for which R8 and R10 represent a hydrogen atom and R9 and R11 represent an ethyl group; or PAG for which R8 and R10 represent a hydrogen atom, R9 represents a methyl group and R11 represents an ethyl group; or PAG for which R8 and R10 represent a hydrogen atom, R9 represents an ethyl group and R11 represents a methyl group; or PAG for which R8, R9 and R11 represent a hydrogen atom and R10 represents a methyl group; or PAG for which R8, R10 and R11 represent a hydrogen atom and R9 represents a methyl group.

For a preferred PAG according to the invention, R3 represents a linear or branched $C_4$-$C_{12}$-alkyl group, R8, R10 and R11 represent a hydrogen atom and R9 represents a methyl group, p represents a number ranging from 3 to 5, for example 4.5, while q represents a number ranging from 1 to 3, for example 2.

For a more preferred PAG according to the invention, R3 represents a linear or branched $C_8$-$C_{12}$-alkyl group, R8 represents a hydrogen atom and R9 represents a methyl group, R10 represents a hydrogen atom and R11 represents an ethyl group. p represents a number ranging from 3 to 8, for example 5, and q represents a number ranging from 3 to 8, for example 4.

More preferably, the PAG of the composition according to the invention is a block polymer of formula (III) or a random polymer of formula (III)

(III)

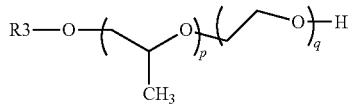

in which:

R3 represents a linear or branched $C_4$-$C_{12}$-alkyl group, preferably a linear or branched $C_4$-alkyl group;

p represents a number ranging from 1 to 30, preferably from 2 to 15 or from 2 to 8;

q represents a number ranging from 1 to 30, preferably from 1 to 10.

As examples of PAG of formula (III), mention may be made of the products of the Synalox 50-B® range marketed by Dow Chemical.

More particularly preferably, the PAG of the composition according to the invention is a block polymer of formula (IV) or a random polymer of formula (IV)

(IV)

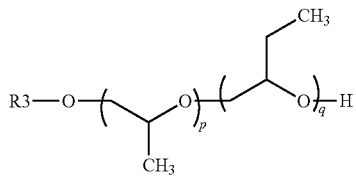

in which:

R3 represents a linear or branched $C_8$-$C_{12}$-alkyl group;

p represents a number ranging from 2 to 6;

q represents a number ranging from 2 to 5.

The PAG used for the composition according to the invention may be prepared by reacting at least one alcohol-type initiator comprising from 1 to 30 carbon atoms with the epoxy bonding of one or more alkylene oxides and then propagation of the reaction in order to obtain these polymers. The preferred alkylene oxides are ethylene oxide, propylene oxide and butylene oxide. Methods for preparing PAG of formula (IV) are described in International Patent Application WO-2012/070007 or in International Patent Application WO-2013/164449.

More particularly preferably, the PAG of the composition according to the invention is a block polymer of formula (V) or a random polymer of formula (V)

(V)

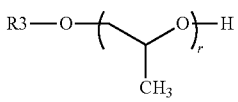

in which:

R3 represents a linear or branched $C_4$-$C_{12}$-alkyl group, preferably a linear or branched $C_4$-alkyl group;

r represents a number ranging from 2 to 60, preferably from 5 to 30 or from 7 to 15.

As examples of PAG of formula (V), mention may be made of the products of the Synalox 100-B® range marketed by Dow Chemical.

More preferably, the PAG is a block polymer of formula (VI) or a random polymer of formula (VI)

(VI)

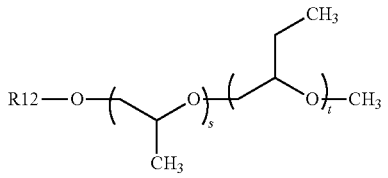

in which:

R12 represents a linear or branched $C_1$-$C_{30}$-alkyl group, preferably a linear or branched $C_8$-$C_{15}$-alkyl group;

s and t independently represent an average number ranging from 1 to 5.

For a preferred PAG according to the invention, R12 represents a group chosen from a linear $C_8$-alkyl group; a branched $C_8$-alkyl group; a linear $C_9$-alkyl group; a branched $C_9$-alkyl group; a linear $C_{10}$-alkyl group; a branched $C_{10}$-alkyl; a linear $C_{11}$-alkyl group; a branched $C_{11}$-alkyl group; a linear $C_{12}$-alkyl group; a branched $C_{12}$-alkyl group; a linear $C_{13}$-alkyl group; a branched $C_{13}$-alkyl group; a linear $C_{14}$-alkyl group; a branched $C_{14}$-alkyl group; a linear $C_{15}$-alkyl group; a branched $C_{15}$-alkyl group.

For a preferred PAG according to the invention:

s is greater than or equal to t; or s represents an average number ranging from 2 to 4.5; or t represents an average number ranging from 1.5 to 4.

For a preferred PAG according to the invention:

s represents an average number ranging from 2.5 to 3.5; or t represents an average number ranging from 2 to 3.

For a preferred PAG according to the invention:

s represents an average number equal to 2.5 and t represents an average number equal to 2; or s represents an average number equal to 3.5 and t represents an average number equal to 2.8.

For a preferred PAG according to the invention:

its kinematic viscosity at 100° C., measured according to the ASTM D445 standard, ranges from 2.5 to 4.5 $mm^2 \cdot s^{-1}$; or its viscosity index is greater than 160 or is between 160 and 210; or its pour point is below −40° C.; or its dynamic viscosity (CCS) at −35° C., measured according to the ASTM D5293 standard, is less than 1,200 mPa·s.

Methods for preparing PAG of formula (VI) are described in application WO-2016/016362.

Preferably, the lubricating composition according to the invention comprises from 1 to 99.5% by weight of PAG.

Preferably, the lubricating composition according to the invention preferably comprises from 5 to 80%, for example from 5 to 70%, from 5 to 60%, from 5 to 50%, from 5 to 40%, preferably from 10 to 80%, for example 10 to 70%, 10 to 60%, 10 to 50%, 10 to 40%, preferably 20 to 80%, for example 20 to 70%, 20 to 60%, from 20 to 50%, from 20 to 40%, preferably from 30 to 80%, for example from 30 to 70%, from 30 to 60%, from 30 to 50%, from 30 to 40%, by weight of PAG.

More preferably, the lubricating composition according to the invention comprises from 1 to 30%, preferably from 1 to 20%, more preferably from 1 to 15% by weight of PAG.

In another more preferred manner, the lubricating composition according to the invention comprises from 40 to 99.5%, preferably from 50 to 99.5%, more preferably from 60 to 99.5%, even more preferably from 70 to 99.5%, advantageously from 80 to 99.5% by weight of PAG.

In addition to a PAG and a nitrogen compound selected from amine phosphates or amine tungstates, the lubricating composition according to the invention may comprise a base oil.

In general, the lubricating composition according to the invention may comprise any type of lubricating base oil, mineral, synthetic or natural, animal or vegetable adapted to its use.

The base oils used in the lubricating compositions according to the invention may therefore be oils of mineral or synthetic origin belonging to groups I to V according to the classes defined in the API classification (or their equivalents according to the ATIEL classification) (Table A) or their mixtures.

Preferably, the base oil is different from the PAG.

TABLE A

| | Saturated content | Sulfur content | Viscosity index (VI) |
|---|---|---|---|
| Group I Mineral oils | <90% | >0.03% | 80 ≤ VI < 120 |
| Group II Hydrocracked oils | ≥90% | ≤□0.03% | 80 ≤ VI < 120 |
| Group III Hydrocracked or hydro-isomerized oils | ≥90% | ≤0.03% | ≥120 |
| Group IV | Polyalphaolefins (PAO) | | |
| Group V | Esters and other bases not included in groups I to IV | | |

The mineral base oils which may be used for the lubricating composition according to the invention include any type of bases obtained by atmospheric and under vacuum distillation of crude oil, followed by refining operations such as solvent extraction, desalting, dewaxing with solvent, hydrotreatment, hydrocracking, hydro-isomerization and hydrofinishing. Mixtures of synthetic and mineral oils may also be used.

There is generally no limitation on the use of different lubricating bases to make the lubricating compositions according to the invention, except that they must have properties, in particular viscosity, viscosity index, sulfur content and oxidation resistance, especially adapted for use for engines or for vehicle transmissions.

The base oils of the lubricating compositions according to the invention may also be chosen from synthetic oils, such as certain carboxylic acid esters and alcohols, as well as from polyalphaolefins. The polyalphaolefins used as base oils are, for example, obtained from monomers comprising from 4 to 32 carbon atoms, for example from octene or decene, and whose viscosity at 100° C. is between 1.5 and 15 $mm^2 \cdot s^{-1}$ according to ASTM D445. Their average molecular weight is generally between 250 and 3000 according to ASTM D5296.

Advantageously according to the invention, the base oil may be chosen from Group III oils, Group IV oils and Group V oils.

Advantageously, the lubricating composition according to the invention may comprise at least 50% by weight of base oils relative to the total mass of the composition. More advantageously, the lubricating composition according to the invention may comprise at least 60% by weight, or even at least 70% by weight, of base oils relative to the total weight of the composition. More particularly advantageously, the lubricating composition according to the invention may comprise from 50, 60 or 70 to 99.9% by weight, or from 50, 60 or 70 to 90% by weight, of one or more base oils relative to the total weight of the composition.

The lubricating composition according to the invention may also comprise at least one additional additive. Many additional additives may be used for the lubricating composition according to the invention. The additional additives preferred for the lubricating composition according to the invention are chosen from detergent additives, different anti-wear additives from compounds chosen from amine phosphates or amine tungstates, friction modifying additives, extreme pressure additives, dispersants, pour point improvers, defoamers, thickeners, and mixtures thereof.

Preferably, the lubricating composition according to the invention comprises at least one inorganic friction modifier chosen from organomolybdenum compounds, preferably from molybdenum dithiocarbamates and their derivatives.

Preferably, the lubricating composition according to the invention comprises from 0.1 to 2% by weight, preferably from 0.1 to 1.5% by weight, more preferably from 0.5 to 1.5% by weight of inorganic friction modifiers.

There is a wide variety of additional different anti-wear additives from compounds selected from amine phosphates or amine tungstates.

The additional anti-wear additives may be chosen from phospho-sulfur additives such as metal alkylthiophosphates, in particular zinc alkylthiophosphates, and more specifically zinc dialkyl-dithiophosphates or ZnDTP. The preferred compounds have the formula $Zn((SP(S)(OR^{13})(OR^{14}))_2$, in which $R^{13}$ and $R^{14}$, which may be identical or different, independently represent an alkyl group, preferably an alkyl group comprising from 1 to 18 carbon atoms.

Advantageously, the lubricating composition according to the invention may comprise from 0.01 to 6% by weight, preferably from 0.05 to 4% by weight, more preferably from 0.1 to 2% by weight relative to the total weight of lubricating composition and additional anti-wear additives.

The lubricating composition according to the invention may comprise at least one organic friction modifying additive. The organic friction modifying additive may be selected from monoesters of fatty acids and polyols, alkoxylated amines, alkoxylated fatty amines, fatty epoxides, borate fatty epoxides; fatty amines or fatty acid glycerol esters. According to the invention, the fatty compounds comprise at least one hydrocarbon group comprising from 10 to 24 carbon atoms.

Advantageously, the lubricating composition according to the invention may comprise at least one antioxidant additive. The antioxidant additive generally serves to retard the degradation of the lubricating composition in use. This degradation may, in particular, result in the formation of deposits, the presence of sludge or an increase in the viscosity of the lubricating composition.

Antioxidant additives act, in particular, as radical inhibitors or destroyers of hydroperoxides. Among the antioxidant additives commonly used, mention may be made of antioxidant additives of the phenolic type, antioxidant additives of the amine type, antioxidant phosphosulfur additives. Some of these antioxidant additives, for example phosphosulfur antioxidant additives, may be ash generators. Phenolic antioxidant additives may be ash-free or may be in the form of neutral or basic metal salts. The antioxidant additives may, in particular, be chosen from sterically hindered phenols, sterically hindered phenol esters and sterically hindered phenols comprising a thioether bridge, diphenylamines, diphenylamines substituted with at least one $C_1$-$C_{12}$-alkyl group, and N,N'-dialkyl-aryl diamines and mixtures thereof.

Preferably, according to the invention, the sterically hindered phenols are chosen from compounds comprising a phenol group in which at least one vicinal carbon of the carbon bearing the alcohol function is substituted by at least one $C_1$-$C_{10}$-alkyl group, preferably a $C_1$-$C_6$-alkyl group, preferably a $C_4$-alkyl group, preferably by the ter-butyl group.

Amino compounds are another class of antioxidant additives that may be used, optionally in combination with phenolic antioxidant additives. Examples of amine compounds are aromatic amines, for example aromatic amines of formula $NR^aR^bR^c$ in which $R^a$ represents an optionally substituted aliphatic or aromatic group, $R^b$ represents an optionally substituted aromatic group, $R^c$ represents a hydrogen atom, an alkyl group, an aryl group or a group of formula $R^dS(O)_zR^e$ wherein $R^d$ represents an alkylene group or an alkenylene group, $R^e$ represents an alkyl group, an alkenyl group or an aryl group, and z represents 0, 1 or 2.

Sulfurized alkyl phenols or their alkali and alkaline earth metal salts may also be used as antioxidant additives.

Another class of antioxidant additives is copper compounds, for example copper thio- or dithio-phosphates, copper and carboxylic acid salts, dithiocarbamates, sulphonates, phenates, copper acetyl-acetonates. Copper salts I and II, succinic acid or anhydride salts may also be used.

The lubricating composition according to the invention may contain all types of antioxidant additives known to those skilled in the art.

Also advantageously, the lubricating composition according to the invention comprises from 0.5 to 2% by weight of at least one antioxidant additive relative to the total weight of the composition.

The lubricating composition according to the invention may also comprise at least one detergent additive. The detergent additives generally make it possible to reduce the formation of deposits on the surface of the metal parts by dissolving the secondary oxidation and combustion products.

The detergent additives that may be used in the lubricating composition according to the invention may be anionic compounds comprising a long lipophilic hydrocarbon chain and a hydrophilic head. The associated cation may be a metal cation of an alkali metal or alkaline earth metal. The detergent additives are preferably chosen from the alkali metal or alkaline earth metal salts of carboxylic acids, the sulphonates, the salicylates, the naphthenates and the phenate salts. The alkali and alkaline earth metals are preferably calcium, magnesium, sodium or barium. These metal salts generally comprise the metal in stoichiometric amount or in excess, therefore in an amount greater than the stoichiometric amount. These are then overbased detergent additives; wherein the excess metal bringing the overbased character to the detergent additive is then generally in the form of a metal salt that is insoluble in oil, for example a carbonate, a hydroxide, an oxalate, an acetate, a glutamate, preferably a carbonate.

Advantageously, the lubricating composition according to the invention may comprise from 2 to 4% by weight of detergent additive relative to the total weight of the lubricating composition.

Also advantageously, the lubricating composition according to the invention may also comprise at least one pour point improver additive.

By slowing the formation of paraffin crystals, pour point improver additives generally improve the cold behavior of the lubricating composition according to the invention.

As examples of pour point improver additives, mention may be made of alkyl polymethacrylates, polyacrylates, polyarylamides, polyalkylphenols, polyalkylnaphthalenes and alkylated polystyrenes.

Advantageously, the lubricating composition according to the invention may also comprise at least one dispersing agent. The dispersing agent may be chosen from Mannich bases, succinimides and their derivatives.

Also advantageously, the lubricating composition according to the invention may comprise from 0.2 to 10% by weight of dispersing agent relative to the total weight of the lubricating composition.

Advantageously, the lubricating composition may also comprise at least one polymer improving the viscosity index. Examples of polymers improving the viscosity index include polymeric esters, homopolymers or copolymers, hydrogenated or non-hydrogenated, of styrene, butadiene and isoprene, polymethacrylates (PMA).

Also advantageously, the lubricating composition according to the invention may comprise from 1 to 15% by weight of the polymer improving the viscosity index relative to the total weight of the lubricating composition.

Preferably, the lubricating composition according to the invention is used for the lubrication of an engine, preferably a vehicle, more preferably a motor vehicle.

Thus, the present invention also relates to the use of a lubricating composition according to the invention for lubricating an engine, preferably a vehicle, more preferably a motor vehicle.

More preferably, the present invention also relates to the use of a lubricating composition according to the invention for lubricating a vehicle engine, more preferably a motor vehicle.

The present invention also relates to a method of lubricating a motor vehicle, preferably a motor vehicle, comprising at least one step of bringing the motor into contact with the lubricating composition according to the invention.

The present invention also relates to the use of a nitrogen compound selected from amine phosphates or amine tungstates to improve the anti-wear properties of a lubricating composition comprising an oil selected from PAG.

All the characteristics and preferences relating to the nitrogen compound and to the PAG described above apply to this use.

The present invention will now be illustrated using non-limiting examples.

EXAMPLE 1: LUBRICATING COMPOSITIONS ACCORDING TO THE INVENTION

Lubricating compositions according to the invention are prepared according to Table 1 below (the compositions are given by weight (g)).

In the compositions below:

PAG 1: PAG comprising propylene oxide and butylene oxide units and an OH termination (corresponding to formula (IV) with p≈2.8 and q≈2.2)

PAG 2: PAG comprising propylene oxide and butylene oxide units and a —$OCH_3$ termination (corresponding to formula (VI) with s≈3.5 and t≈2.8)

PAG 3 (Synalox 50-15B® marketed by the company DOW CHEMICAL): PAG based on ethylene oxide units and propylene oxide units PAG 4 (Synalox 100-20B® marketed by DOW CHEMICAL): PAG based on propylene oxide units PAG 5: PAG comprising propylene oxide and butylene oxide units and an —OH termination (corresponding to formula (IV) with p≈5 and q≈4)

nitrogen compound 1 (Irgalube 349® marketed by the company BASF): mixture of compound of formula (IA) and of compound of formula (IB) in which R1 represents a hexyl or ethylhexyl group, while R2 represents an alkyl group comprising from 11 to 14 carbon atoms.

nitrogen compound 2 (Vanlube W-324® marketed by the company Vanderbilt): mixture of at least one amine tungstate obtained from at least one fatty amine comprising at least one linear alkyl group comprising from 11 to 14 carbon atoms and an amine tungstate obtained from at least one fatty amine comprising at least one branched alkyl group comprising from 11 to 14 carbon atoms friction modifier (Sakuralube 525® marketed by the company Adeka): molybdenum dithiocarbamate base oil (Yubase 4+® marketed by the company SK): Group III base oil (kinematic viscosity of 4.1 $mm^2/s$ measured at 100° C. according to the ASTM D445 standard)

polymer 1 (Viscoplex 6-565® marketed by the company Evonik): polymethacrylate polymer 2 (SV203® marketed by Infineum): hydrogenated polyisoprene/styrene additive package: succinimide dispersant, zinc dithiophosphate anti-wear, calcium salicylate detergent, phenolic antioxidant, diphenylamine antioxidant

TABLE 1

| Composition | 1 | 2 | 3 | 4 | 5 | 6 | 7 | 8 |
|---|---|---|---|---|---|---|---|---|
| PAG 1 | 98.9 | 99.5 | | 98.4 | | | | |
| PAG 2 | | | 98.9 | | 98.4 | | | |
| PAG 3 | | | | | | 98.4 | | |
| PAG 4 | | | | | | | 98.4 | |
| PAG 5 | | | | | | | | 8 |
| Nitrogen compound 1 | 1.1 | | 1.1 | 1.1 | 1.1 | 1.1 | 1.1 | 1.1 |
| Nitrogen compound 2 | | 0.5 | | | | | | |
| Friction modifier | | | | 0.5 | 0.5 | 0.5 | 0.5 | |
| Base oil | | | | | | | | 74.4 |
| Polymer 1 | | | | | | | | 2.8 |
| Polymer 2 | | | | | | | | 2.9 |
| Package of additives | | | | | | | | 10.9 |

EXAMPLE 2: EVALUATION OF ANTI-WEAR PROPERTIES

This evaluation is based on a procedure based on the ASTM D2670 standard requiring the use of a FALEX tribometer and whose test conditions are described below.

test pieces: FALEX steel
break-in time: 300 s
test duration: 180 min
break-in load: 445 N
test load: 1335 N
speed: 290 rpm
ambient temperature The results are presented in Table 2 and are expressed in μm; the lower the value obtained, the better the anti-wear properties of the evaluated composition

TABLE 2

| Composition | 1 | 2 | 3 | 4 | 5 | 6 | 7 | 8 |
|---|---|---|---|---|---|---|---|---|
| Total wear (μm) | 28 | 24 | 24 | 38 | 24 | 18 | 44 | 28 |

The results show that the lubricating compositions according to the invention (compositions 1 to 8) have good anti-wear properties.

It should be noted that the improvement of the anti-wear properties is actually obtained:

in the presence or absence of additional base oils, in the presence or absence of additional additives.

The invention claimed is:

1. Lubricating composition comprising from 1 to 30 wt % of an oil selected from polyalkyl glycols (PAG or polyalkylene glycols), a nitrogen compound selected from amine tungstates and further comprising a friction modifier selected from organomolybdenum compounds, and derivatives thereof.

2. Lubricating composition according to claim 1 for which the nitrogen compound is chosen from:

amine tungstates obtained from at least one fatty amine comprising at least one linear alkyl group comprising from 8 to 15 carbon atoms;

amine tungstates obtained from at least one fatty amine comprising at least one branched alkyl group comprising from 8 to 15 carbon atoms;

a mixture of at least one amine tungstate obtained from at least one fatty amine comprising at least one linear alkyl group comprising from 8 to 15 carbon atoms, and an amine tungstate obtained from at least one fatty amine comprising at least one branched alkyl group comprising from 8 to 15 carbon atoms.

3. Lubricating composition according to claim 1, wherein the PAG is a block polymer of formula (II) or a random polymer of formula (II)

(II)

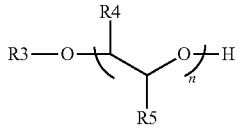

in which:

R3 represents a linear or branched $C_1$-$C_{30}$-alkyl group;

n represents a number ranging from 2 to 60;

R4 and R5, identical or different, independently represent a hydrogen atom or a $C_1$-$C_2$-alkyl group.

4. Lubricating composition according to claim 1 for which the PAG is chosen from a block polymer of formula (IIA) or a random polymer of formula (IIA)

(IIA)

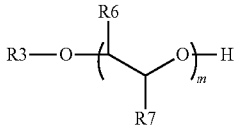

in which:

R3 represents a linear or branched $C_1$-$C_{30}$-alkyl group;

m represents a number ranging from 2 to 60;

R6 and R7 represent a hydrogen atom; or R6 represents a hydrogen atom and R7 represents a methyl group; or R6 represents a methyl group and R7 represents a hydrogen atom; or R6 and R7 represent a methyl group; or R6 represents an ethyl group and R7 represents a hydrogen atom; or R6 represents a hydrogen atom and R7 represents an ethyl group;

a block polymer of formula (IIB) or a random polymer of formula (IIB)

(IIB)

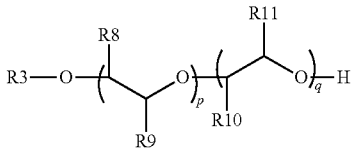

in which:

R3 represents a linear or branched $C_1$-$C_{30}$-alkyl group;

p and q independently represent a number ranging from 1 to 30;

R8 and R9 represent a hydrogen atom; or R8 represents a hydrogen atom and R9 represents a methyl group; or R8 represents a methyl group and R9 represents a hydrogen atom; or R8 and R9 represent a methyl group; or R8 represents an ethyl group and R9 represents a hydrogen atom; or R8 represents a hydrogen atom and R9 represents an ethyl group;

R10 and R11 represent a hydrogen atom; or R10 represents a hydrogen atom and R11 represents a methyl group; or R10 represents a methyl group and R11 represents a hydrogen atom; or R10 and R11 represent a methyl group; or R10 represents an ethyl group and R11 represents a hydrogen atom; or R10 represents a hydrogen atom and R11 represents an ethyl group.

5. Lubricating composition according to claim 1 for which the PAG is chosen from a block polymer of formula (III) or a random polymer of formula (III)

(III)

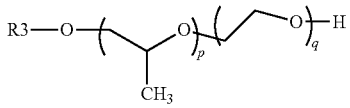

in which:

R3 represents a linear or branched $C_4$-$C_{12}$-alkyl group;

p represents a number ranging from 1 to 30;

q represents a number ranging from 1 to 30, or a block polymer of formula (IV) or a random polymer of formula (IV)

(IV)

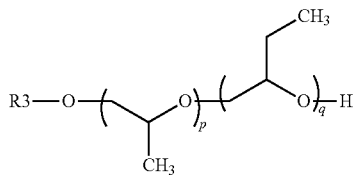

in which:

R3 represents a linear or branched $C_8$-$C_{12}$-alkyl group;

p represents a number ranging from 2 to 6;

q represents a number ranging from 2 to 5;

a block polymer of formula (V) or a random polymer of formula (V)

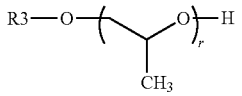

(V)

in which:

R3 represents a linear or branched $C_4$-$C_{12}$-alkyl group;

r represents a number ranging from 2 to 60.

6. Lubricating composition according to claim 1, wherein the PAG is a block polymer of formula (VI) or a random polymer of formula (VI)

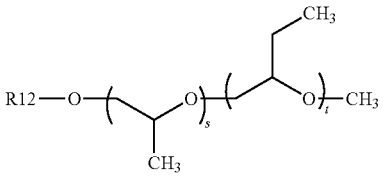

(VI)

in which:

R12 represents a linear or branched $C_1$-$C_{30}$-alkyl group;

s and t independently represent an average number ranging from 1 to 5.

7. Lubricating composition according to claim 1, comprising from 1 to 20% by weight of PAG.

8. Lubricating composition according to claim 1, comprising from 1 to 15% by weight of PAG.

9. Lubricating composition according to claim 1, comprising from 0.1 to 3% by weight of nitrogen compound.

10. Lubricating composition according to claim 1, comprising a lubricating base oil.

11. Method for the lubrication of an engine or for the lubrication of an automobile engine comprising at least one step of bringing the motor into contact with the lubricating composition according to claim 1.

* * * * *